US005957731A

United States Patent [19]

Nishihara et al.

[11] Patent Number: 5,957,731

[45] Date of Patent: Sep. 28, 1999

[54] SOCKET AND SOCKET HOLDER FOR CAPLESS INCANDESCENT LAMP

[75] Inventors: Hiroyoshi Nishihara, Tokyo; Katunori Sato, Tochigi; Kazuaki Murata, Tokyo, all of Japan

[73] Assignee: Moriyama Sangyo Kabushiki Kaisha, Japan

[21] Appl. No.: 08/945,517

[22] PCT Filed: Jun. 5, 1996

[86] PCT No.: PCT/JP96/01509

§ 371 Date: Oct. 24, 1997

§ 102(e) Date: Oct. 24, 1997

[87] PCT Pub. No.: WO97/31220

PCT Pub. Date: Aug. 28, 1997

[30] Foreign Application Priority Data

Feb. 26, 1995 [EP] European Pat. Off. ... PCT/JP96/00435

[51] Int. Cl.[6] ..... H01R 33/00

[52] U.S. Cl. ..... 439/698

[58] Field of Search ..... 439/698, 239

[56] References Cited

U.S. PATENT DOCUMENTS

| | | | |
|---|---|---|---|
| 3,633,149 | 1/1972 | Maltais | 439/612 |
| 3,810,077 | 5/1974 | Salzer | 439/698 |
| 3,944,808 | 3/1976 | Vause | 362/296 |

*Primary Examiner*—Neil Abrams
*Assistant Examiner*—Michael C. Zarroli
*Attorney, Agent, or Firm*—Morrison Law Firm

[57] ABSTRACT

An incandescent lamp (1) to be connected to a socket (11) includes a glass tube (2) having a sealing portion (5) at each end thereof, and a generally U-shaped lead portion (4*a*) connected to a filament (3) disposed in the glass tube (2) is projected from each sealing portion 5. A socket body (12) of the socket (11) includes a base portion (21) and a pair of socket portions (22) respectively rising from both ends of the base portion (21). Each socket portion (22) is provided with a sealing portion groove (27*a*) and a lead portion groove (27*b*), which are adapted to respectively permit the sealing portion (5) and the lead portion (4*a*) at the corresponding end of the incandescent lamp (1) to be removably inserted. A pair of feeding terminal pieces (34) of a lamp contact terminal (13) are disposed in each socket portion (22) at such a position as to face the lead portion groove (27*b*). With the configuration as above, when the incandescent lamp (1) is inserted and connected to the socket, the positions to which the respective lead portions (4*a*) of the incandescent lamp (2) are inserted can be easily set, by inserting the sealing portions (5) and the lead portion (4*a*), one each of which is provided at each end of the incandescent lamp (1), respectively into the sealing portion grooves (27*a*) and the lead portion grooves (27*b*) of the socket portions (22) at both ends of the socket (11). Then, each lead portion (4*a*) can be inserted between the pair of feeding terminal pieces (34) of the corresponding lamp contact terminal (13), which face the lead portion groove (27*b*).

25 Claims, 9 Drawing Sheets

SOCKET AND SOCKET HOLDER FOR CAPLESS INCANDESCENT LAMP

This is a PCT application entering the United States national stage. A priority date is claimed as of Feb. 26, 1996.

BACKGROUND OF THE INVENTION

The present invention relates to a socket for an incandescent lamp in the shape of a straight tube, which is typically used for decorative illumination or general illumination. The invention also relates to a socket device using said socket.

Background of the Invention

Examples of well-known conventional straight tube type incandescent lamp used for decorative illumination or general illumination include a small incandescent lamp wherein a filament is installed in a cylindrical glass tube that has a flat sealing portion at each end; a pair of lead wires are respectively connected to both ends of the filament and are projected from the respective sealing portions at both ends of the glass tube to the outside of the glass tube; and wherein lead portions are formed by bending the projected portion of each lead wire into the shape of the letter U extending virtually parallel to the flat portion of the corresponding sealing portion. An incandescent lamp described above has no caps so that the lead portion of each lead wire functions as an electrical connection portion.

An example of sockets for an incandescent lamp structured as above is disclosed in Japanese Utility Model No. 1427197, which calls for mechanically supporting and electrically connecting an incandescent lamp by providing a socket body or a similar member with a pair of hooking terminals disposed opposite each other, and hooking the lead portions at both ends of the incandescent lamp to the respective hooking terminals, thereby disposing the incandescent lamp between the two hooking terminals.

However, a socket described above is not capable of providing reliable mechanical and electrical connection of the incandescent lamp, because the connecting operation is done simply by hooking the lead portions of the incandescent lamp to the hooking terminals. Furthermore, when attaching or removing the incandescent lamp, it is necessary to hook or unhook the lead portions while elastically deforming the hooking terminals. In other words, mounting and dismounting cannot be easily done according to the above configuration.

Other well-known examples of sockets include those described in Japanese Patent Laid-open No. 225482/1988 and Japanese Utility Model Laid-open Nos. 4086/1987, 193686/1986 and 85840/1986, although they all involve a lamp having a cap at each end, which is a lamp of a different type from the one related to the configuration described above, i. e. a capless type incandescent lamp. The aforementioned patent public disclosure and utility model public disclosures provide a structure of a socket which calls for inserting an electrical connector portion, which is in the shape of a plate or a bar and projects from a cap, between a pair of terminal pieces of a lamp contact terminal disposed in a socket, so that said electrical connector portion is mechanically supported between the two terminal pieces and electrically connected to the same.

In the above configuration of a socket, the lamp contact terminals through which electrical current flows are disposed deep inside the socket in order to prevent them from being inadvertently exposed to the outside of the socket. Therefore, when inserting an electrical connector portion of a cap of the lamp from the outside of the socket for electrical connection, it is difficult to set the insertion position between the pair of terminal pieces of the lamp contact terminal disposed in the inner part of the socket interior. In short, the above configuration is not convenient to connect an electrical connector portion to a lamp contact terminal. Especially in cases where a socket having such a structure is used for an incandescent lamp of the capless type described above, the incapability of setting an insertion position often causes the incandescent lamp to be displaced in the axial direction with respect to the socket, which may result in various problems, for example, causing a sealing portion to abut against a lamp contact terminal and prevent insertion of the lamp or to be accidentally inserted between the pair of terminal pieces of the lamp contact terminal.

In order to solve the above problems, an object of the present invention is to provide a socket and a socket device using said socket wherein mechanical and electrical connection of a capless type incandescent lamp to the socket can be executed easily and reliably, and wherein an insertion position of each lead portion of the incandescent lamp with respect to a lamp contact terminal disposed in the socket can be easily set when the incandescent lamp is inserted and connected to the socket, so that the lead portions of the incandescent lamp can be reliably connected to the lamp contact terminals and that the incandescent lamp can be connected to the socket at a position fixed with respect to the axial direction of the lamp tube.

BRIEF SUMMARY OF THE INVENTION

The present invention relates to a socket to which a straight tube type incandescent lamp is connected, said incandescent lamp including a glass tube having a sealing portion at each end, a filament disposed in the glass tube, and a pair of lead wires connected to the filament, each lead wire having a generally U-shaped lead portion projecting from the sealing portion at the corresponding end of the glass tube to the outside of the glass tube, wherein the socket includes a socket body and lamp contact terminals, said socket body having a base portion and a pair of socket portions positioned opposite each other and respectively rising from the two ends of the base portion as an integral body with the base portion, each socket portion having a sealing portion groove and a lead portion groove adapted to permit a sealing portion and a lead portion of the incandescent lamp to be respectively inserted therein and removed therefrom, the sealing portion groove formed at the inner end, i. e. the end facing toward the inner end of the other socket portion, and the lead portion groove being narrower than is the sealing portion groove and closer to the outer end of the socket portion than the sealing portion groove, and each lamp contact terminal having a pair of feeding terminal pieces to be so disposed in one of the two socket portions of the socket body as to face the lead portion groove so that when a lead portion of said incandescent lamp inserted into the lead portion groove, the lamp contact terminal secures the lead portion between the feeding terminal pieces, thereby connecting the lead portion to the terminal. Therefore, by respectively inserting the sealing portions and the lead portions at both ends of the incandescent lamp into the sealing portion grooves and the lead portion grooves of the socket portions at both ends of the socket, each lead portion can be inserted between a pair of feeding terminals of a lamp contact terminal disposed in the corresponding socket portion so that the mechanical and electrical connection of the lead portions is done in the state where the lead portions are supported between the feeding terminal pieces. Thus, the present invention makes it easy to set insertion positions for the lead portions of an incandescent lamp with respect to the lamp contact terminals disposed in the socket portions when the incandescent lamp is inserted and connected into the socket, and ensures reliable connection of the lead portions of the incandescent lamp to the lamp contact terminals as well as connection of the incandescent lamp at a fixed position with respect to the axial direction of the lamp tube.

According to another feature of the invention, a protrusion which is adapted to be removably engaged in a generally U-shaped lead portion of an incandescent lamp inserted between a pair of feeding terminal pieces is formed on one of said feeding terminal pieces and protrudes therefrom toward the other feeding terminal piece. Because of this feature, the invention is capable of stopping a lead portion supported between each pair of feeding terminal pieces, thereby preventing the lead portion from inadvertently slipping off.

According to yet another feature of the invention, a stopper which is adapted to limit the insertion position of a lead portion of an incandescent lamp inserted between a pair of feeding terminal pieces is formed on one of said feeding terminal pieces and protrudes therefrom to the other pair of feeding terminal pieces. Because of this feature, the invention is capable of limiting the insertion position of each lead portion when the lead portion is inserted between each pair of feeding terminal pieces, thereby ensuring connection of the incandescent lamp at a fixed position with respect to the direction of insertion.

According to yet another feature of the invention, a reflection plate is provided on the surface of the base portion of the socket body, said surface facing the space between the pair of socket portions. By means of this reflection plate, the invention is capable of reflecting heat radiated from an illuminated incandescent lamp, thereby shielding the base portion from heat, and also increasing the reflection efficiency in the direction in which the reflection plate faces. As a result of shielding the base portion from heat, it is possible to reduce an unfavorable influence of the heat, such as yellowing or blackening, on other members or the surface (of an existing structure) on which the base portion is mounted.

According to yet another feature of the invention, the reflection plate includes a base plate portion that covers the surface of the base portion, and protruding piece portions to be respectively fitted in the sealing portion grooves of the socket portions at both ends of the socket body, each protruding piece portion protruding from each respective end of the base plate portion. By engaging the protruding piece portions at both ends of the reflection plate in the respective sealing portion grooves of the socket portions at both ends of the socket, the reflection plate can be mounted on the socket at a fixed position.

According to yet another feature of the invention, each socket portion at each respective end of the socket body is provided with a reflection plate support portion for removably supporting the corresponding end of the reflection plate. Therefore, the reflection plate can be easily mounted on the socket, or, when it is already mounted, removed or replaced.

According to yet another feature of the invention, each lamp contact terminal includes a receiving terminal portion that faces the underside of the base portion of the socket body. Therefore, when attaching other components, such as a flat cable or a base cover, to the underside of the socket body, electrical power can be supplied by connecting wires of the flat cable or terminals in the base cover to the receiving terminal portions.

According to yet another feature of the invention, the invention includes said socket and a flat cable which is in the shape of a belt and includes belt-shaped flat electrical wires and a belt-shaped insulating cover that envelopes and insulates the flat wires, the flat cable adapted to permit the underside of the socket body of said socket to be joined and fixed thereto, and the receiving terminal portions of the respective lamp contact terminals to be connected to the flat wires. Because of this feature, the invention allows a plurality of incandescent lamps to be successively arranged along the flat cable, thereby improving effects of decorative illumination or general-purpose lighting.

According to yet another feature of the invention, the invention includes an elongated rail adapted to house the flat cable along the bottom of its interior, wherein said rail has a generally U-shaped cross section and is provided with catching portions that respectively extend along the inner sides of the rail and adapted to catch and support the socket bodies of the sockets. Because of the configuration as above, the invention provides a socket which is more convenient to install in that its flat cable can be mounted on a mounting surface (of an existing structure) such as a wall or a ceiling surface via the rail.

According to yet another feature of the invention, the invention includes said socket, a base cover, and a pair of line-connecting terminals to be disposed in the base cover, said base cover joined to the underside of the socket body of the socket and having at least a pair of wire insertion holes, each line-connecting terminal having a connector portion and lock terminal portions, the connector portion adapted to be connected to the receiving terminal piece of each respective lamp contact terminal, and each lock terminal portion so disposed as to face each respective wire insertion hole and securing an electrical wire inserted into the wire insertion hole so that the electrical wire is connected without the danger of slipping. As a single-use type socket device can be formed by combining a socket with a base cover or other components according to this feature of the invention, the invention makes it possible to install the socket device at a desired location and consequently improve effects of decorative illumination or general-purpose lighting.

According to yet another feature of the invention, the base cover has such a configuration that a pair of wire insertion holes are formed at each end of the base cover; said pair of line-connecting terminals are disposed between the wire insertion holes at both ends of the base cover; and that a lock terminal portion is formed at each end of each respective line-connecting terminal, at such a position as to face each respective insertion hole. The configuration as above enables transmitting wiring by inserting the pair of electrical wires at the power feeding side into the wire insertion holes at one end of the base cover in order to connect said power feeding wires to the socket and inserting the other electrical wires, i. e. the wires for transmitting power to another socket device or a component, into the wire insertion holes at the end of the base cover in order to connect said power transmitting wires to the socket.

BEST MODE FOR CARRYING OUT THE INVENTION

Next, the first embodiment of the present invention is described in the following by referring to FIGS. 1 to 4.

Figure 1:
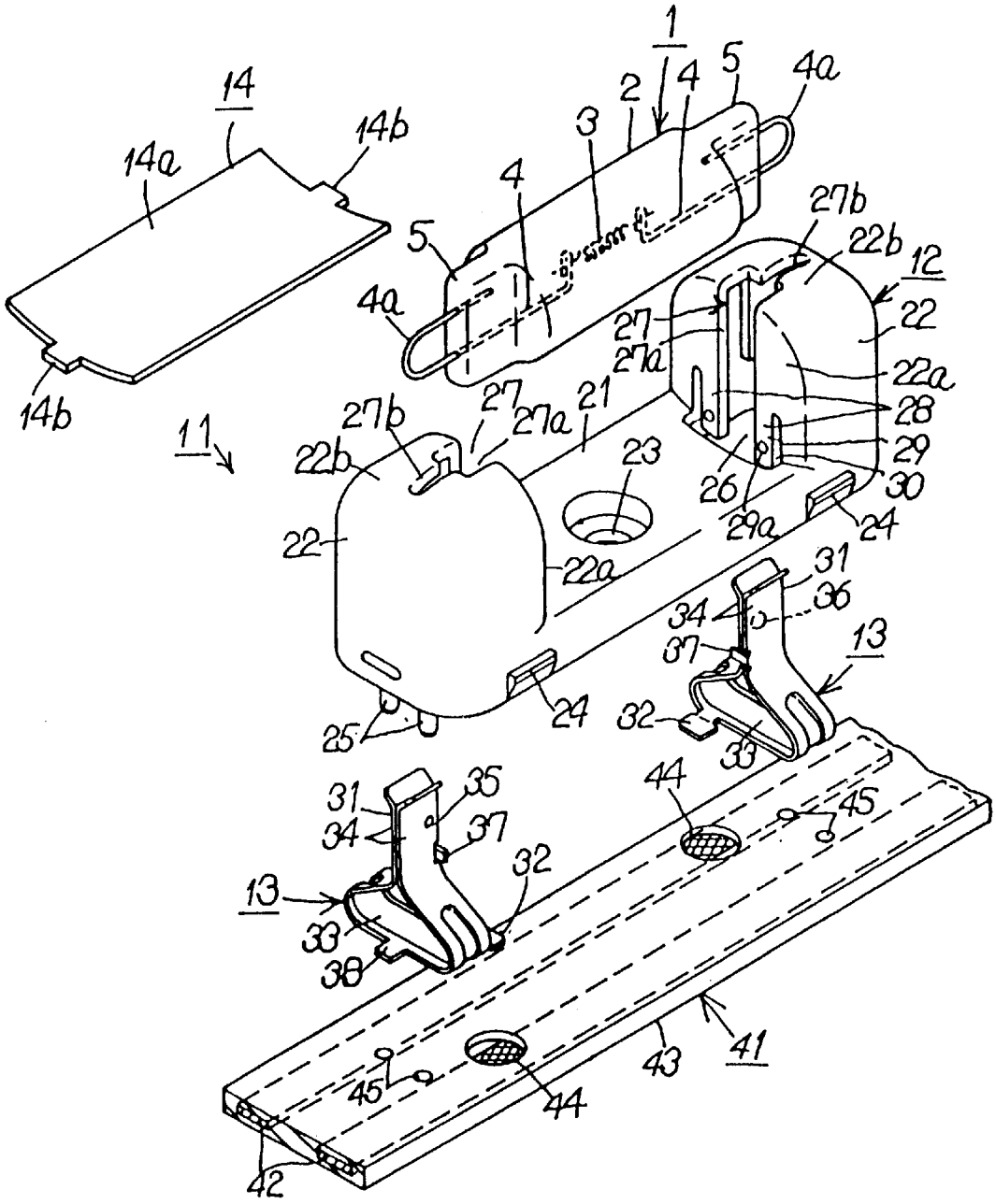
FIG. 1 is an exploded perspective view of a socket device according to a first embodiment of the present invention.

In FIG. 1, numeral 1 denotes an incandescent lamp, which is of a capless type and has a virtually transparent, cylindrical glass tube 2. A filament 3 is disposed at the center of the interior of glass tube 2 and extends along the axis of the tube 2. A pair of lead wire 4 is connected to each end of the filament 3 and projected from the corresponding end of the glass tube 2. Each end of the glass tube 2 is sealed by a sealing portion 5, to which the middle portion of each lead wire 4 is fastened so that the portion of the lead wire 4 projecting from the sealing portion 5 constitutes a lead portion 4*a* for electrical connection. Each lead portion 4*a* projecting from the corresponding sealing portion 5 to the outside of the device is bent in a U-shaped, extending nearly parallel to the flat surface of the sealing portion 5. With the configuration as above, the incandescent lamp 1 has a total length of about 35 mm including the sealing portions 5.

Numeral 11 denotes a socket, which includes a socket body 12, a pair of lamp contact terminals 13 and a reflection plate 14.

A socket body 12 is made of an insulating synthetic resin such as polypropylene and comprises a base portion 21 and a pair of socket portions 22 integrally formed with the base portion 21. The socket portions 22 are formed at the two lengthwise ends of the base portion 21, at opposing locations. The base portion 21 is laterally elongated, i. e. in the axial direction of the tube, and adapted to permit the incandescent lamp 1 to be connected thereto.

The upper surface of the base portion 21 is curved at both sides, i. e. the sides extending perpendicularly to the length of the base portion, with a curvature corresponding to the circumferential surface of the incandescent lamp 1 to be connected to the socket 11, and, at the center of the upper surface of the base portion 21, a mounting hole 23 is vertically bored through the base portion. A pair of stopper teeth 24 are formed on each side of the base portion 21, each stopper tooth 24 having a tapered lower surface and a horizontal upper surface and located near each end of the side face of the base portion 21. A pair of mounting bosses 25 are formed at each end of the underside of the base portion 21 as an integral body with the base portion and project downward.

The distance between the two socket portions 22 facing toward each other is longer than the length of the glass tube 2 of the incandescent lamp 1 without the sealing portions 5 and shorter than the total length of the same including the sealing portions 5.

A terminal housing space 26 open at the bottom is formed in each socket portion 22, and a groove 27 communicating with the terminal housing space 26 is formed uninterruptedly from the inner end face 22*a* (the end opposite the other socket portion 22) to the upper end face 22*b* (the surface facing the direction in which the socket portion is raised) of each socket portion 22. Each groove 27 comprises a groove 27*a* adapted to receive the sealing portion therein (hereinafter referred to as the sealing portion groove 27*a*) and a groove 27*b* adapted to receive the lead portion therein (hereinafter referred to as the lead portion groove 27*b*). The sealing portion groove 27*a* is formed in the part ranging from the inner end face 22*a* to an inner part of the upper end face 22*b* and permits a sealing portion 5 of the incandescent lamp 1 to be removably inserted, while the lead portion groove 27*b* is formed in an outer part of the upper end face 22*b* and permits a lead portion 4*a* to be removably inserted. The widths and the tube-axial positions of the sealing portion groove 27*a* and the lead portion groove 27*b* of each socket portion 22 respectively correspond to the widths and the tube-axial positions of the associated sealing portion 5 and the lead portion 4*a* of the incandescent lamp 1, the lead portion groove 27*b* being narrower than the sealing portion groove 27*a*.

Formed on the inner end face 22*a* of each socket portion 22 is a reflection plate support portion 28 for removably supporting each end of the reflection plate 14. Each reflection plate support portion 28 has a pair of supporting pieces 29 which are formed on both sides of the lower part of the sealing portion groove 27*a* in the inner end face 22*a*. As a slit 30 is formed along the side of each supporting piece 29, the supporting piece is connected to the inner end face 22*a* only at the upper end of the supporting piece. A hemispherical protrusion 29*a* is formed on the upper surface of the base portion 21 corresponding to the thickness of the reflection plate 14.

A lamp contact terminal 13 to be housed in the terminal housing space 26 of each socket portion 22 of the socket body 12 is made of a conductive metal which is capable of serving as a spring. Each lamp contact terminal 13 comprises a feeding terminal portion 31 and a receiving terminal portion 32 formed as an integral body with the feeding terminal portion 31 and facing the bottom of the socket body 12. Being adapted to securely sandwich a lead portion 4*a* which is inserted thereinto by way of the lead portion groove 27*b*, the feeding terminal portion 31 provides electrical connection to the lead portion 4*a*.

Each feeding terminal portion 31 includes a base plate 33, from each end of which rises a pair of feeding terminal pieces 34. The upper parts of the pair of feeding terminal pieces 34 are arranged parallel to each other and bonded together in such a manner that their upper ends are angled outward, away from each other.

One of each pair of feeding terminal pieces 34 has a protrusion 35 protruding toward the other feeding terminal piece 34 so as to removably fit in the generally U-shaped lead portion 4*a* sandwiched between and thus electrically connected to the pair of feeding terminal pieces 34, and the other feeding terminal piece 34 is provided with an indentation 36 to receive the protrusion 35 therein.

Also formed on the one feeding terminal piece 34 is a stopper 37 for restricting the position where the lead portion 4*a* is inserted between the two feeding terminal pieces 34, the stopper 37 protruding from the inner edge of the feeding terminal piece 34, which inner edge faces the surface of the sealing portion groove 27*a*, toward the other feeding terminal piece 34.

A protruding piece 38 is formed at the center of the outer edge of each base plate 33, i. e. the side opposite the inner side where the stopper 37 is formed, while the protruding receiving terminal portion 32 is formed near an end of the inner edge of the base plate 33 so as to protrude downward from the bottom of the base plate 33.

Figure 2:
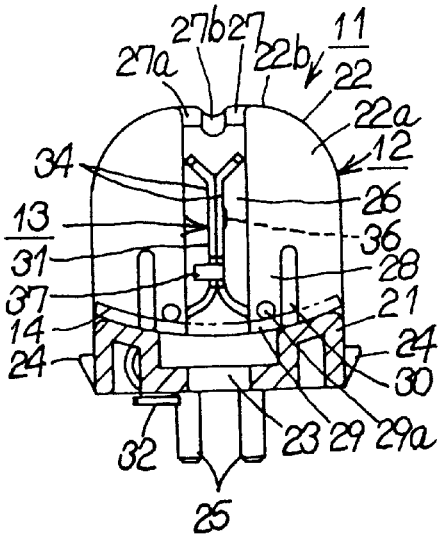
FIG. 2 is a sectional view of the same.
Figure 3:
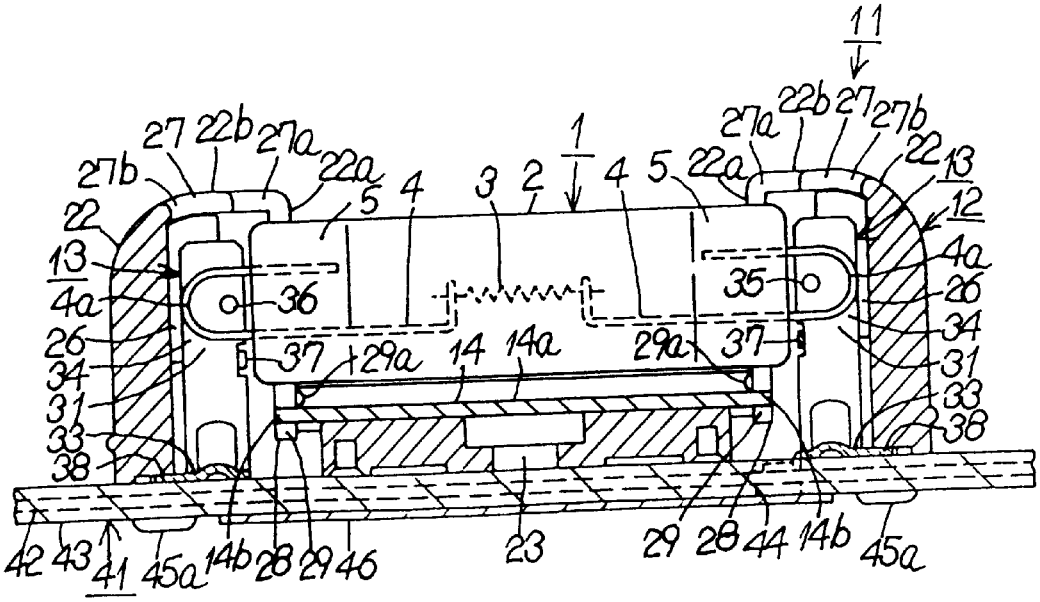
FIG. 3 is a sectional view of the socket of the same in the assembled state.

As shown in FIGS. 2 and 3, in the state where a lamp contact terminal 13 is contained in the terminal housing space 26 in a socket portion 22 of the socket body 12, the pair of feeding terminal pieces 34 are arranged parallel to each other and face the surface of the sealing portion groove 27*a* formed in the inner end face 22*a* of the socket portion 22, while the upper ends of the feeding terminal pieces 34 face the lead portion groove 27*b*. The lower end face of the base plate 33 is virtually flush with the bottom of the socket body 12, with the protruding piece 38 being in contact with the bottom of the socket body 12, and the receiving terminal portion 32 protrudes from the bottom of the socket body 12.

The reflection plate 14 is removably attached to the upper surface of the base portion 21, between the pair of socket portions 22 of the socket body 12. The reflection plate 14 may be made of aluminum and has a base plate portion 14*a* that has a shape nearly identical to the top of the base portion 21. A protruding piece portion 14*b* to be fitted in the sealing portion groove 27*a* of the corresponding socket portion 22 of the socket body 12 is formed at each end of the base plate portion 14*a* and protrudes therefrom. In the same manner as the upper surface of the base portion 21, the base plate portion 14*a* is curved at both sides, i. e. the sides extending perpendicularly to the two ends of the base plate, with a curvature corresponding to the circumferential surface of the incandescent lamp 1 to be connected to the socket 11.

As a shiny reflection surface would permit projection of the shadow of the filament 3 of the incandescent lamp 1 and may result in uneven illumination, a diffusing surface treatment, such as sand blasting, may be preferably given to the reflection surface of the reflection plate 14 in order to prevent such an uneven illumination.

The reflection plate 14 can be mounted on the socket body 12 by fitting the reflection plate 14 between the socket portions 22 at both ends of the socket body 12 in such a manner as to fit the protruding piece portions 14*b* at both ends of the reflection plate 14 in the sealing portion grooves 27*a* of the respective socket portions 22, and lowering the reflection plate 14 toward the base portion 21. Immediately before the reflection plate 14 is joined to the upper surface of the base portion 21, both ends of the reflection plate 14 come into contact with the protrusions 29*a* formed on the respective supporting pieces 29 of the socket portions 22 and move over the protrusions 29*a* while elastically pushing the supporting pieces 29 outward. When the lower surface of the reflection plate 14 is joined to the upper surface of the base portion 21, the protrusions 29*a* of the respective supporting pieces 29 elastically catch the upper surfaces of both ends of the reflection plate 14 so that the reflection plate 14 is supported between the base portion 21 and the protrusions 29*a*. On the other hand, the reflection plate 14 can be removed upward from the socket body 12 by reversing the process for mounting, i. e. by moving the reflection plate 14 upward so that both ends of the reflection plate 14 move over the protrusions 29*a* while elastically pushing the supporting pieces 29 outward.

A socket device is constituted by combining a socket 11 structured as above with a flexible flat cable 41.

The flat cable 41 comprises a pair of flat electrical wires 42 enveloped in an insulating covering body 43 into a belt-like shape. Window openings 44 are respectively formed at the locations where the socket is attached to the flat cable 41, by vertically cutting through the covering body 43 at the locations corresponding to the receiving terminal portions 32 of the lamp contact terminals 13 so that the flat wires 42 are exposed from the respective window openings 44. The flat cable 41 is also provided with two pairs of mounting holes 45, each pair of which are bored through the flat cable 41, between the pair of flat wires 42 at locations corresponding to the mounting bosses at each end of the socket body 12.

When assembling the socket device, first of all, the pair of lamp contact terminals 13 shown in FIG. 1 are arranged at the appropriate locations on the flat cable 41 so that the receiving terminal portion 32 of each lamp contact terminal 13 comes into contact with each respective flat wire 42 through the corresponding window opening 44 of the flat cable 41, and the receiving terminal portions 32 and the respective flat wires 42 are welded together by means of spot welding, resistance welding or other appropriate welding means.

Next, each lamp contact terminal 13 on the flat cable 41 is engaged in the socket portion 22 at each respective end of the socket body 12, and the mounting bosses 25 projecting from the lower surface of the socket body 12 are respectively inserted into the mounting holes 45 of the flat cable 41 so that the bottom of the socket body 12 comes into surface contact with the top of the flat cable 41, with the mounting bosses 25 projecting from the lower surface of the flat cable 41.

Then, the end of each mounting boss 25 projecting from the lower surface of the flat cable 41 is crimped to form a crimped portion 45*a* shown in FIG. 3 by a crimping means such as fusion welding by applying ultrasonic vibration or heating, thereby fastening the socket body 12 and the flat cable 41 to each other. A seat 46 covering the window openings 44 is bonded to the lower surface by means of, for example, adhesive or high-frequency welding.

Next, the reflection plate 14 is fitted to the socket portions 22 at both ends of the socket body 12 and moved downward so that the reflection plate 14 is supported between the base portion 21 and the protrusions 29*a* of the supporting pieces 29 of the socket portions 22.

As shown in FIG. 3, when the socket device is in the assembled state, the protruding piece 38 of each lamp contact terminal 13 contained in the terminal housing space 26 of each respective socket portion 22 of the socket body 12 is supported between the socket body 12 and the flat cable 41. The pair of feeding terminal pieces 34 of each lamp contact terminal 13 are arranged parallel to each other and face the surface of the sealing portion groove 27*a* formed in the inner end face 22*a* of the socket portion 22 (see FIG. 2), while the upper ends of the feeding terminal pieces 34 face the lead portion groove 27*b*.

The socket device to be used for such as decorative illumination or normal lighting is constituted by successively arranging and mounting a plurality of sockets 11 on the flat cable 41 in the manner described above.

When connecting an incandescent lamp 1 to a socket 11, the sealing portion 5 and the lead portion 4*a* at each end of the incandescent lamp 1 are respectively inserted into the sealing portion groove 27*a* and the lead portion groove 27*b* of each respective socket portion 22 in the state the incandescent lamp 1 is maintained at a horizontal position as shown in FIG. 1, wherein the sealing portions 5 at both ends of the incandescent lamp 1 and the flat surfaces of the lead portion 4*a* extend vertically.

Each lead portion 4*a* of the incandescent lamp 1 inserted through the corresponding lead portion groove 27*b* into the socket 22 is directed into the space between the upper ends of the pair of feeding terminal pieces 34 of the corresponding lamp contact terminal 13 and inserted further while the feeding terminal pieces 34 are pushed outward against their elasticity, until the lead portion 4*a* catches the protrusion 35 in its generally U-shaped loop. The insertion position of each lead portion 4*a* is restricted by abutment of the lead portion 4*a* against the stopper 37 of lamp contact terminal 13.

When electric current is fed to the pair of the flat wires 42 of the flat cable 41, the current flows to the filament 3 of the incandescent lamp 1 through the lamp contact terminals 13, thereby lighting the incandescent lamp 1.

On the other hand, the incandescent lamp 1 can be removed upward from the socket 11 by reversing the process for mounting, i. e. by pulling the incandescent lamp 1 upward so that each lead portion 4*a* is pulled from between the pair of feeding terminal pieces 34 of the corresponding lamp contact terminal 13.

Figure 4:
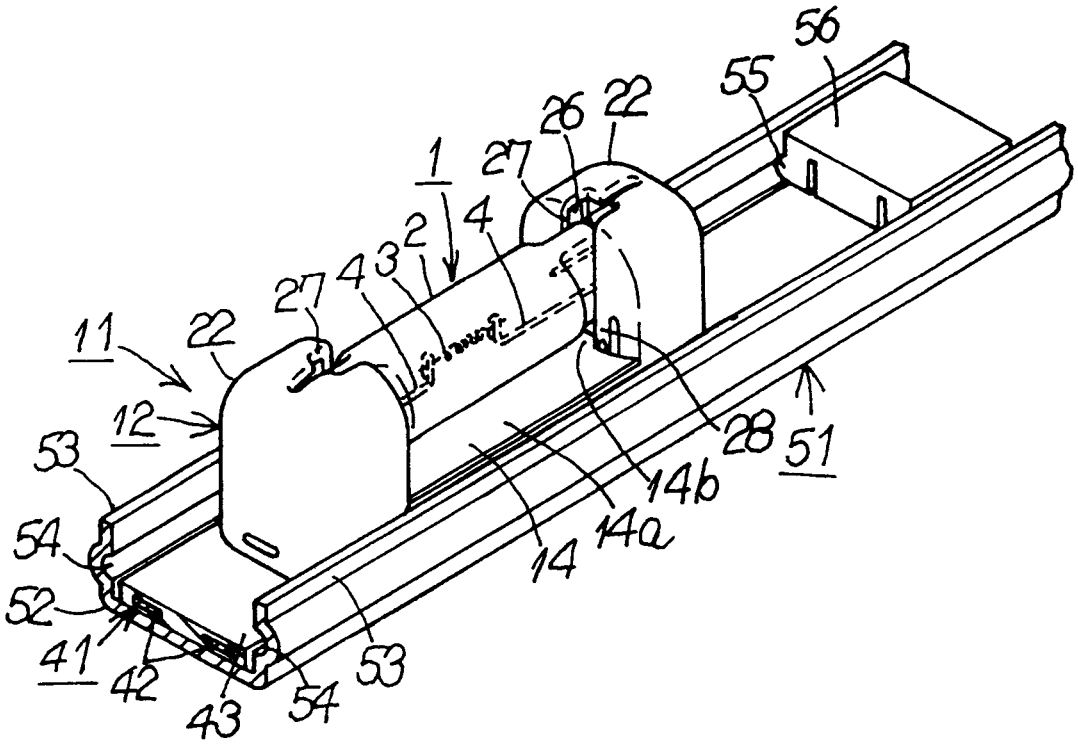
FIG. 4 is a perspective view of the said socket device in the assembled state.

Further, as shown in FIG. 4, a flexible flat cable 41 may be mounted on a rail 51. In this case, the rail 51 is an elongated member which has an approximately U-shaped section and formed of a bottom plate 52 and side plates 53 arranged opposite each other. Each side plate 53 has a groove 54 that extends along the length of the side plate. With the configuration as above, an assembly operation is done by placing the flat cable 41 from above the rail 51 onto the bottom plate 52 so that the flat cable extends along the length of the rail, and inserting the socket 11 between the side plates 53. With the stopper teeth 24 on both sides of the socket 11 caught in the grooves 54 of the rail 51, the flat cable 41 is supported at the bottom of the interior of the rail 51.

A cable presser 56 having stopper teeth 55, which are similar to the stopper teeth 24, on each side of the cable presser 56 may be provided between each two adjacent sockets 11 and attached to the rail 51 so that the flat cable 41 can be supported on the bottom of the interior of the rail 51 at locations between each respective two sockets adjacent to each other.

According to the configuration of a socket 11 described above, it is possible to connect the lead portions 4*a* of an incandescent lamp 1 in the state they are respectively supported by the feeding terminal portions 31 of the lamp contact terminals 13 in the socket portions 22 by inserting the lead portions 41 into the grooves 27 of the socket portions 22. Thus, the configuration described above facilitates attachment and removal of an incandescent lamp 1 and ensures reliable mechanical support and electrical connection of the incandescent lamp 1.

Especially because of the feature wherein each socket portion 22 of the socket body 12 is provided with a groove 27 which is formed uninterruptedly from the inner end face 22*a* to the upper end face 22*b* of the socket portion 22, and wherein a pair of feeding terminal portions 34 of each lamp contact terminal 13 are arranged parallel to each other and face the surface of the sealing portion groove 27*a* formed in the inner end face 22*a* of the corresponding socket portion 22, with the upper ends of the feeding terminal pieces 34 facing the upper end face 22*b* of the socket portion 22 bent outward, away from each other, the configuration described above further facilitates attachment and removal of the incandescent lamp 1 and is capable of more reliable mechanical support and electrical connection of the incandescent lamp 1 in that it is possible to mount or remove the incandescent lamp 1 by moving the incandescent lamp 1 parallel to the direction in which the socket portions 22 are raised.

As the groove 27 of each socket portion 22 of the socket body 12 is provided with a sealing portion groove 27*a* in which a sealing portion 5 of an incandescent lamp 1 is inserted and a lead portion groove 27*b* in which a lead portion 4*a* is inserted, the respective points where the sealing portions 5 and lead portions 4*a* of the incandescent lamp 1 are inserted in the socket 11 at the time of insertion of the incandescent lamp 1 for electrical connection are fixed, and it is easier to fix insertion points to which the lead portions 4*a* of the incandescent lamp 1 are positioned when they are inserted into the respective lamp contact terminals 13 in the socket portions 22. As a result, the lead portions 4*a* of the incandescent lamp 1 can be reliably connected to the lamp contact terminals 13, and the incandescent lamp 1 can be connected at a fixed location with respect to the tube axial direction. As the ends of the sealing portions 5 are respectively positioned in the socket portions 22, the lead portions 4*a* through which electrical current flows are reliably sheltered in the socket portions 22.

Furthermore, a protrusion 35 which protrudes from one of each pair of feeding terminal pieces 34 toward the other feeding terminal piece 34 removably catches the generally U-shaped lead portion 4*a* that is supported between said pair of feeding terminal pieces 34 and electrically connected thereto, thereby preventing the lead portion 4*a* from inadvertently slipping off.

As each pair of feeding terminal pieces 34 is provided with a stopper 37 protruding from one of said feeding terminal pieces 34 toward the other feeding terminal piece 34, it is possible to restrict the insertion point of the lead portion 4*a* inserted between said pair of feeding terminal pieces 34 and, consequently, it is also possible to mount the incandescent lamp 1 at a fixed location with respect to the direction in which the lamp is inserted.

As a reflection plate 14 mounted on the top of the base portion 21 between the pair of socket portions 22 of the socket body 12 reflects the heat radiated from the illuminated incandescent lamp 1, it is possible to shield the base portion 21 from the heat. As a result of this thermal insulation by the reflection plate 14, the temperature of the flat cable 41 and the surface of a structure where the socket is mounted can be reduced from about 150° C. in cases where the reflection plate 14 is not used to about 110° C. in cases where the reflection plate 14 is used. Therefore, it is possible to reduce an unfavorable influence of the heat, such as yellowing or blackening, on the flat cable 41 or the surface (of the structure) on which the socket is mounted. Furthermore, providing a reflection plate 14 increases the light reflection efficiency in the direction in which the reflection plate 14 faces; more precisely, the reflection efficiency can expectedly be increased by approximately 20% compared with a case where the reflection plate 14 is not used. As the reflection plate 14 is made of aluminum, it is also effective in restricting static electricity and thereby preventing accumulation of dust.

By fitting the protruding piece portions 14*b* at both ends of the reflection plate 14 in the sealing portion grooves 27*a* of the socket portions 22 at both ends of the socket body 12, the reflection plate 14 can be mounted at a fixed location with respect to the socket 11.

As the socket portions 22 at both ends of the socket 11 are provided with reflection plate support portions 28 adapted to removably support both ends of the reflection plate 14, the reflection plate 14 can be easily mounted on the socket 11 and, after the mounting, removal or replacement of the reflection plate 14, too, can be easily done.

As each lamp contact terminal 13 has a receiving terminal portion 32 that faces the bottom of the base portion 21 of the socket body 12, electrical power can be supplied to the lamp contact terminals 13 by connecting the flat wires 42 of the flat cable 41 to the receiving terminal portions 32 when the flat cable 41 and any other necessary components are attached to the bottom of the socket body 12.

As a socket device is formed of a combination of a socket 11 and a flat cable 41, a plurality of incandescent lamps 1 may be successively arranged along the flat cable 41. The embodiment described above is thus capable of improving effects of decorative illumination or general-purpose lighting.

Furthermore, a configuration wherein the flat cable 41 is supported by a rail 51 is more convenient to install, because it permits the flat cable 41 to be mounted on a mounting surface such as a wall or a ceiling surface of an existing structure.

Next, a second embodiment of the present invention is explained hereunder, referring to FIGS. 5 to 10.

Except that the mounting bosses 25 of the socket body 12 are cut off or not formed in the first place, the incandescent lamp 1 and the socket 11 according to the second embodiment have the same configurations as those of the first embodiment shown in FIGS. 1 to 4, and the explanation thereof is omitted.

According to the second embodiment, a socket device of a single-use type is formed of a combination of a socket 11, base cover 61, a pair of line-connecting terminals 71 and a pair of release buttons 91.

Referring to the drawings, the base cover 61 is formed of an insulating synthetic resin such as polypropylene and is adapted to be so mounted as to cover the underside of the socket body 12. A partition plate 62 extending laterally, i. e. in the direction perpendicular to both end faces, so as to divide the interior of the base cover 61 is erected from the inner underside of the base cover 61, thereby forming a pair of terminal housing spaces 63 open at the top.

Wire insertion holes 64 that communicate with the corresponding ends of the respective terminal housing spaces 63 are formed at each end of base cover 61. A catching recess 65 that communicates with the corresponding ends of the terminal housing spaces 63 and includes a groove portion 66 open at the end of the cover 61 is formed at each end of the upper part of the base cover 61.

Formed at the center of the partition plate 62 is a boss 68 having a mounting hole 67, which is coaxial with the mounting hole 23 of the socket body 12. A protrusion 69 adapted to be engaged in a catching hole (not shown), which is formed in the underside of the socket body 12 so as to position the base cover 61, is formed in proximity of each end of the partition plate 62.

The pair of line connecting terminals 71, each of which is made of a conductive metal having sufficient elasticity to serve as a spring, in an identical shape and housed in the respective terminal housing spaces 63 of the base cover 61 in a point-symmetrical manner. Each wire connecting terminal 71 includes a laterally elongated base plate 72 to be disposed along the inner wall of a terminal housing space 63. Formed at each end of the wire connecting terminal 71 is a lock terminal portion 73 which comprises a horizontal piece 74 formed by bending the upper end of the base plate 72 so as to extend virtually horizontally therefrom, a vertical piece 75 formed by bending the end portion of the horizontal piece 74 downward, and a generally V-shaped locking piece 76 formed by bending the outer end portion of the vertical piece 75 towards the center of the base plate 72.

The horizontal piece 74 at an end of each wire connecting terminal 71 is provided with a connecting piece 77 to be electrically connected and affixed to the receiving terminal portion 32 of the corresponding lamp contact terminal 13 by means of, for example, spot welding or resistance welding so as to serve as a connector portion.

With the configuration as above, when the wire connecting terminals 71 are respectively placed in the terminal housing spaces 63 of the base cover 61, the lock terminal portions 73 at both ends of the wire connecting terminals 71 are so positioned as to respectively face the inner sides of the wire insertion holes 64 of the base cover 61. Therefore, electrical wires 81 inserted into the respective wire insertion holes 64 can be connected to and secured by the wire connecting terminals 71. Each wire 81 is comprised of a core wire 82 coated with a coating member 83, wherein the end of the coating member 83 is removed, thereby exposing the end of the core wire 82. When said end of the core wire 82 is forced through the wire insertion hole 64 between the base plate 72 and the locking piece 76, the locking piece 76 presses the core wire 82 against the base plate 72, with the tip of the locking piece 76 biting into the core wire 82 and thereby preventing it from slipping off.

Figure 8:
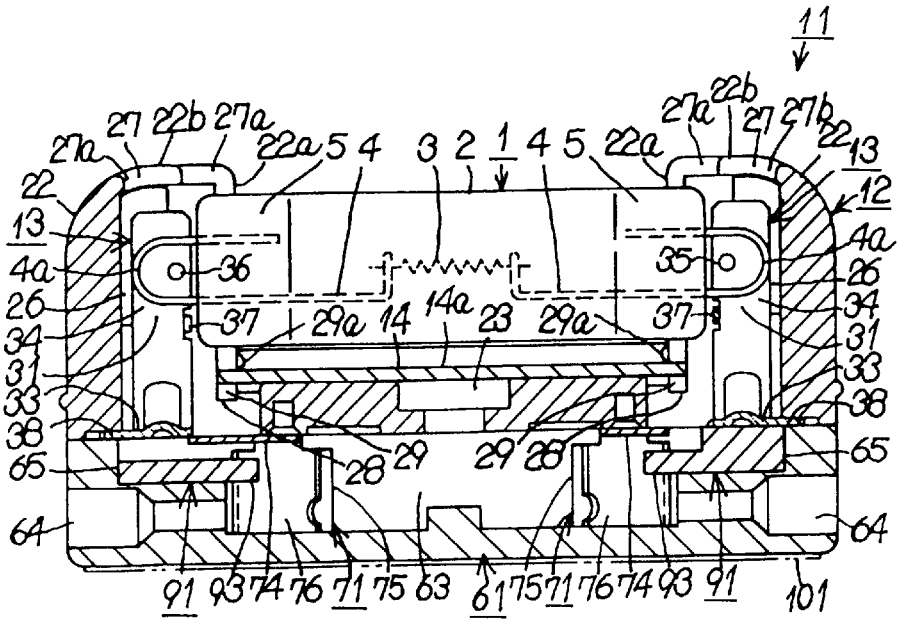
FIG. 8 is a sectional view of the same in the assembled state.

Each one of the pair of release buttons 91 is adapted to be fitted in a catching recess 65 at either end of the base cover 61 in such a manner as to be capable of sliding in the longitudinal direction of the base cover 61. Each release button 91 comprises an operating portion 92 and arm portions 93. The operating portion 92 is formed at one end and adapted to be fitted in a groove portion 66 while the arm portions 93 are formed at the other end of the release button 91 and respectively project into the terminal housing spaces 63. As shown in FIG. 8, each arm portion 93 is adapted to advance underneath the corresponding horizontal piece 74 of each respective wire connecting terminal 71 and face the upper part of the end of the locking piece 76.

One face of a pressure sensitive adhesive double coated tape 101 is securely bonded to the underside of the base cover 61. A released paper (not shown) is applied to the other face of the pressure sensitive adhesive double coated tape 101 so that the adhesive surface is exposed by removing this released paper.

Figure 5:
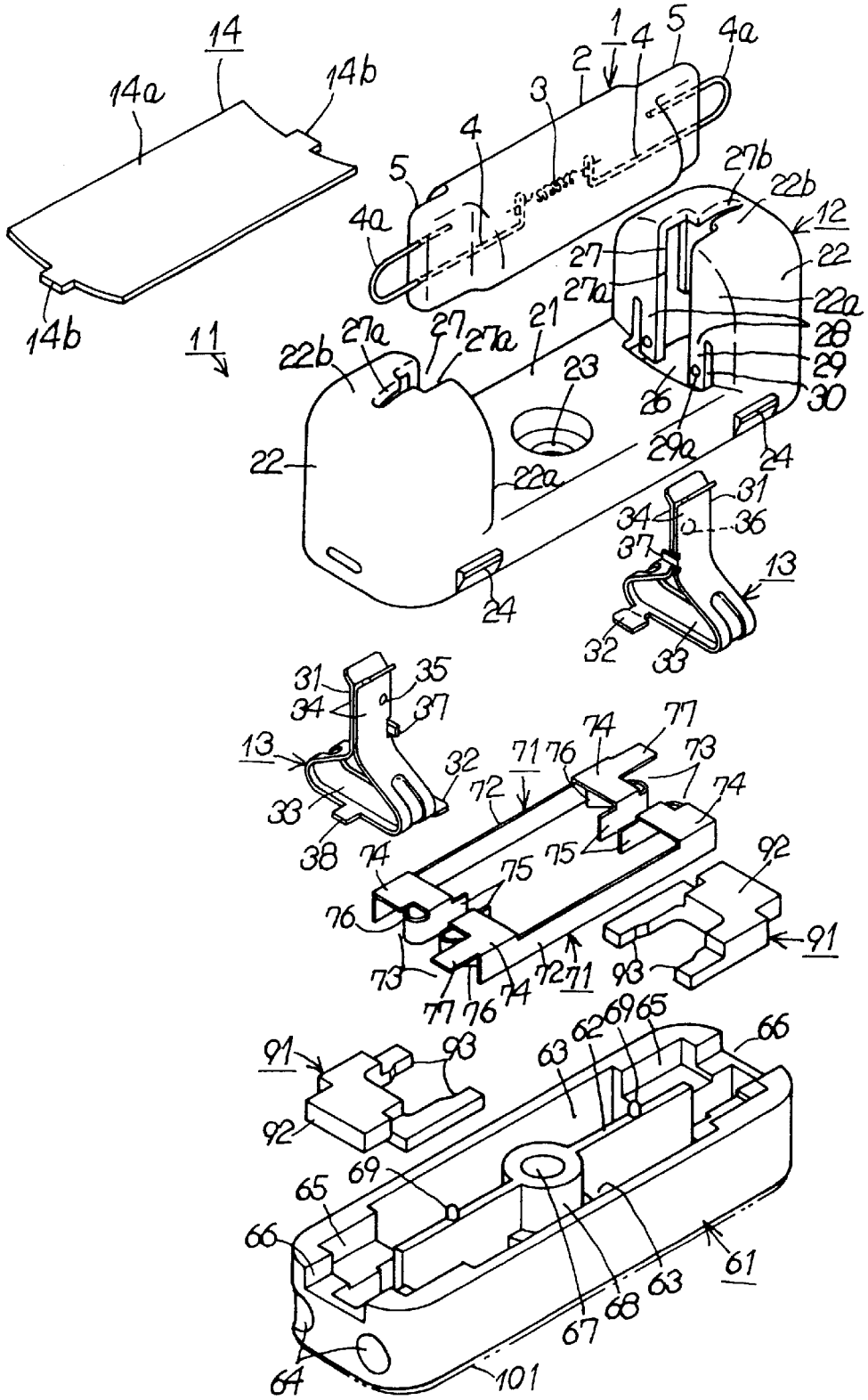
FIG. 5 is an exploded perspective view of a socket device according to a second embodiment of the present invention.
Figure 6:
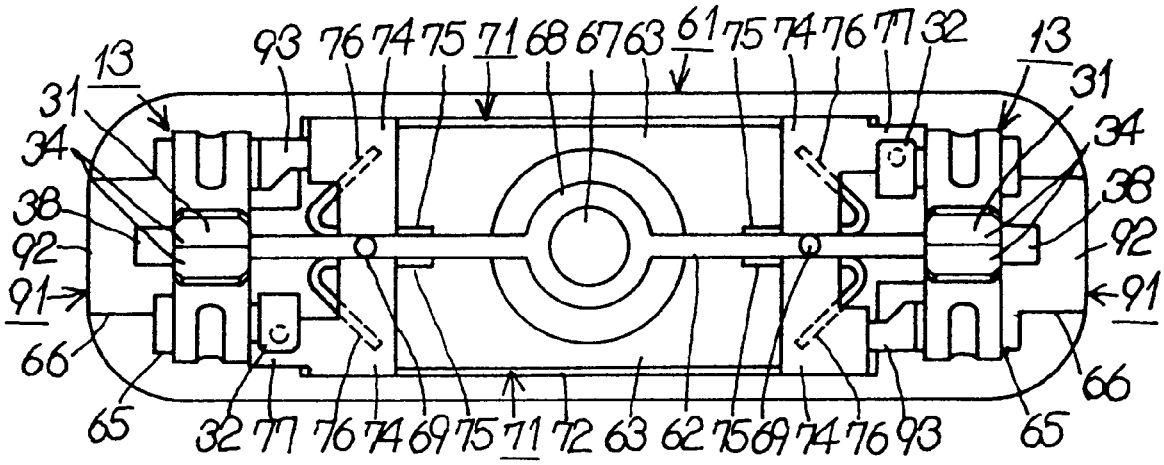
FIG. 6 is a top view of a base cover of the same.
Figure 7:
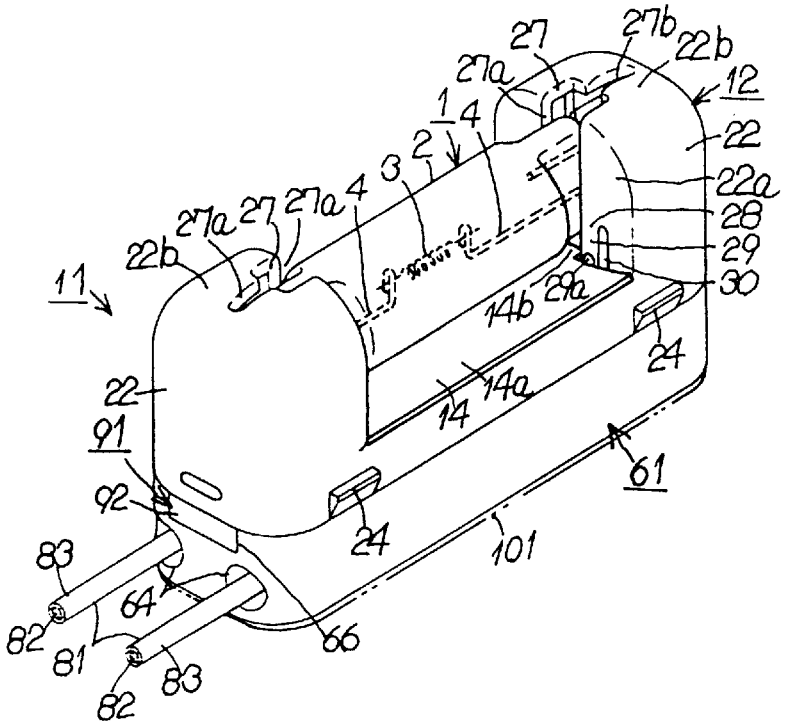
FIG. 7 is a perspective view of the socket device according to said embodiment in the assembled state.

When assembling the socket device, first of all, the release buttons 91 shown in FIG. 5 are respectively fitted in the catching recesses 65 of the base cover 61, and the lamp contact terminals 13 and the wire connecting terminals 71, welded together are inserted into the terminal housing spaces 63.

Figure 9:
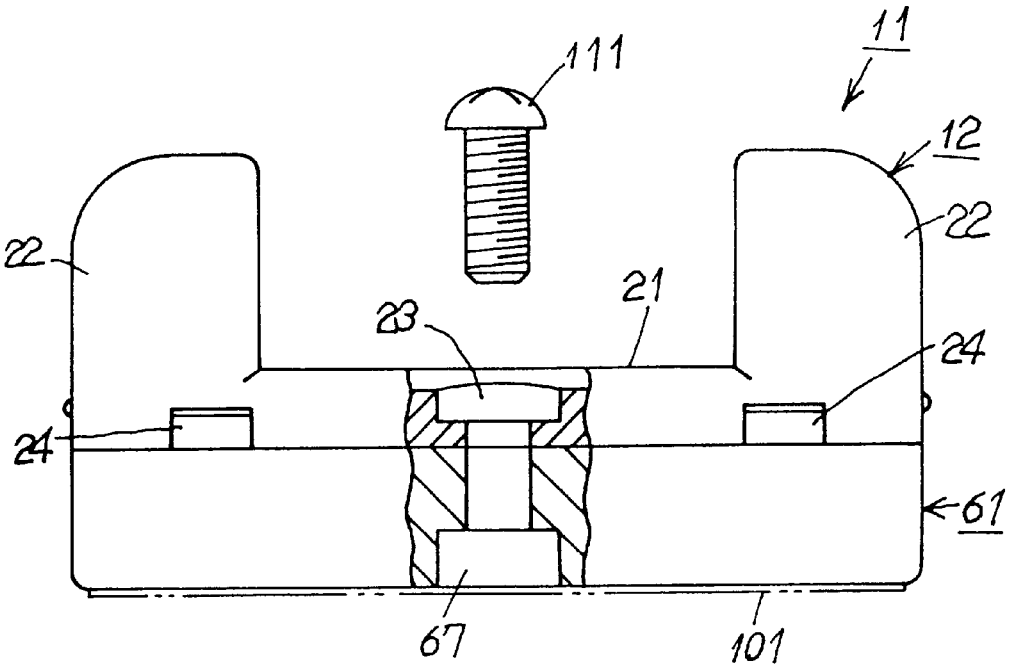
FIG. 9 is a partially cutout side view of the same showing its stopping mechanism using a screw.
Figure 10:
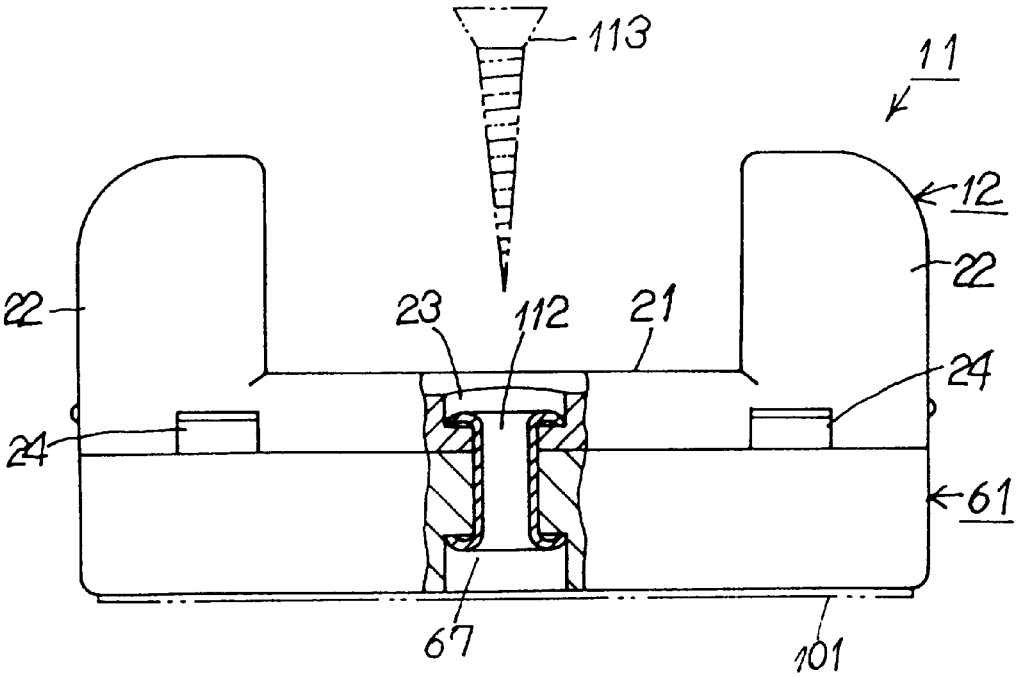
FIG. 10 is a partially cutout side view of the same showing its stopping mechanism using a crimping member.

Next, the socket body 12 and the base cover 61 are joined together into an integral body while engaging the lamp contact terminals 13 respectively in the socket portions 22 at both ends of the socket body 12, and the socket body 12 and the base cover 61 are then secured to each other. The securing means for this purpose may be comprised of screwing a screw 111 through the mounting hole 23 of the socket body 12 into the mounting hole 67 of the base cover 61 as shown in FIG. 9, or, as shown in FIG. 10, inserting a cylindrical crimp member 112 through the mounting hole 23 of the socket body 12 and the mounting hole 67 of the base cover 61 and then respectively crimping the upper and lower ends of the crimp member 112 over the ends of the mounting holes 23 and 67.

After the socket 11 is mounted on the mounting surface of an existing structure, the reflection plate 14 is attached to the socket body 12.

When the socket device is in the assembled state, the lock terminal portions 73 at the respective two ends of each wire connecting terminal 71 face the inner sides of wire insertion holes 64 of the base cover 61, while the arm portions 93 of the release buttons 91 face the upper part of the ends of the respective locking pieces 76 of the wire connecting terminals 71. The protrusions 38 of the lamp contact terminals 13 are sandwiched between the socket body 12 and the release buttons 91 that are fitted in the base cover 61. The pair of feeding terminal pieces 34 of each lamp contact terminal 13 are arranged parallel to each other and face the surface of the groove 27 formed in the inner end face 22*a* of the socket portion 22, while the upper ends of the feeding terminal pieces 34 face the lead portion groove 27*b* of the groove 27.

A pair of electrical wires 81 (the wires for feeding power to the socket) are respectively inserted into the wire insertion holes 64 at an end of the base cover 61 in order for connection of the wires 81, while another pair of electrical wires 81 for transmitting power to another socket device or component are respectively inserted into the wire insertion holes 64 at the other end of the base cover 61 for connection of the wires. The connection of the wires 81 is done by forcing the end of the core wire 82 of each wire 81 through the corresponding wire insertion hole 64 into the gap between the base plate 72 and the locking piece 76, so that the locking piece 76 presses the core wire 82 against the base plate 72, with the tip of the locking piece 76 biting into the core wire 82 and thereby preventing it from slipping off.

Wires 81 inserted in wire insertion holes 64 of the base cover 61 can be removed by pushing the release button 91 above the wire insertion holes 64 into the base cover 61 so that each arm portion 93 of the release button 91 sliding inward of the base cover 61 pushes the corresponding locking piece 76 of the wire connecting terminals 71, thereby causing the tip of the locking piece 76 to move away from the base plate 72. As a result, the core wires 82 are released from the locking pieces 76, which have been biting into the core wires 82 and pushing them against the base plates 72, so that the wires 81 can be removed from the wire insertion holes 64.

In cases where the socket body 12 and the base cover 61 are secured together by means of a screw 111 as shown in FIG. 9, the socket 11 can be mounted on the mounting surface (of an existing structure) by peeling off the released paper of the pressure sensitive adhesive double coated tape 101 and securing bonding the socket 11 to the mounting surface. In cases where the socket body 12 and the base cover 61 are secured together by means of a crimp member 112 as shown in FIG. 10, first of all, the socket 11 may be temporarily secured by peeling off the released paper of the pressure sensitive adhesive double coated tape 101 and pressing the socket 11 against the mounting surface, and then affixed to on the mounting surface by screwing a wood-screw 113 through the interior of the crimp member 112 into the mounting surface.

After the socket 11 is mounted on the mounting surface (of the existing structure), the reflection plate 14 is mounted on the socket body 12.

An incandescent lamp 1 can be attached to or removed from the socket 11 by following the same process as that for the first embodiment described above.

When electric current is fed to the pair of wires 81, the current flows to the filament 3 of the incandescent lamp 1 through the wire connecting terminals 71 and the lamp contact terminals 13, thereby lighting the incandescent lamp 1. Electric current also flows through the wire connecting terminals 71 to the transmitting wires 81 connected to these wire connecting terminals 71.

Forming a single-use socket device by combining a socket 11 with a base cover 61 and other components enables the installation of the socket device at a desired location, thereby improving effects of decorative illumination or general-purpose lighting.

As a socket 11 described above can be used both as an integrated type socket affixed to a flat cable 41 and a single-use type to be solely used in combination with a base cover or other components, it is effective in cost reduction.

Furthermore, other than being used in combination with a flat cable 41, a base cover 61, etc., a socket 11 according to the embodiment can be used alone by connecting electric wires or similar members directly to the lamp contact terminals 13.

Figure 11:
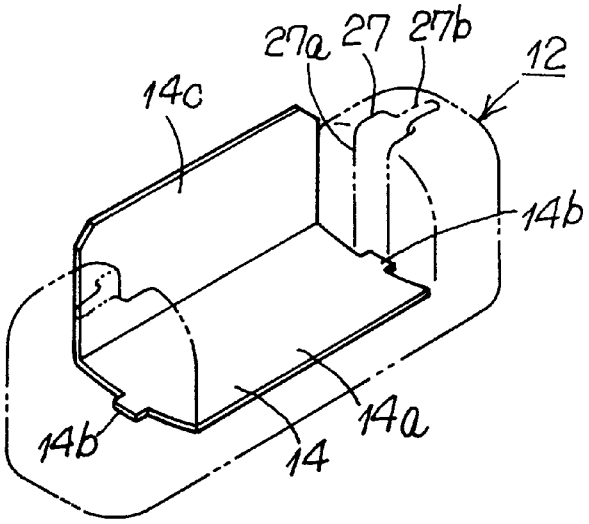
FIG. 11 is a perspective view of a reflection plate according to a third embodiment of the present invention.

Next, as a third embodiment of the present invention, an alternative structure of a reflection plate 14 is shown in FIG. 11, wherein the reflection plate 14 comprises a base plate portion 14*a* and a reflection plate portion 14*c* formed by bending a side of the base plate portion 14*a* at nearly a right angle. The reflection plate portion 14*c* has the same width as the base plate portion 14*a*, and, when attached to the socket, its upper end is nearly flush with the upper ends of the socket portions 22. Providing this reflection plate portion 14*c* is not only effective in blocking the light irradiated from the incandescent lamp 1 to the side where the reflection plate portion 14*c* is located when the lamp is lit but also improves the efficiency of light reflection in other directions, such as the direction opposite the reflection plate portion 14*c*.

Figure 12:
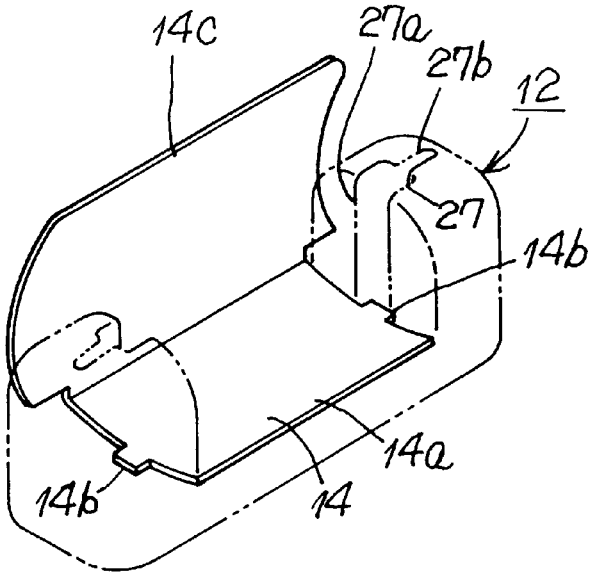
FIG. 12 is a perspective view of a reflection plate according to a fourth embodiment of the present invention.

Next, another structure of a reflection plate 14 is shown in FIG. 12 as a fourth embodiment of the present invention, wherein the reflection plate 14 comprises a base plate portion 14*a* and a reflection plate portion 14*c* formed by bending a side of the base plate portion 14*a* at nearly a right angle. The reflection plate portion 14*c* is wider than the base plate portion 14*a*, and, when attached to the socket, its upper end projects higher than the upper ends of the socket portions 22 and is curved with a curvature corresponding to the circumferential surface of the incandescent lamp 1. Providing this reflection plate portion 14*c* is not only effective in blocking the light radiated from the incandescent lamp 1 to the side where the reflection plate portion 14*c* is located when the lamp is lit but also improves the efficiency of light reflection in other directions, such as the direction opposite the reflection plate portion 14*c*.

Figure 13:
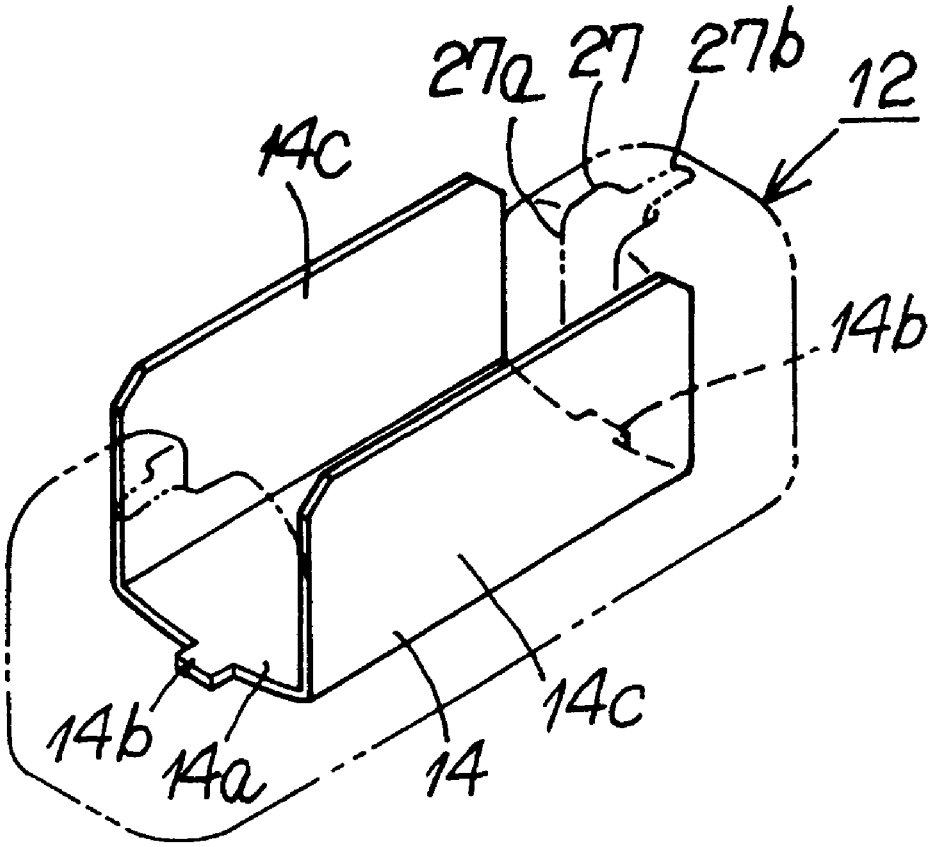
FIG. 13 is a perspective view of a reflection plate according to a fifth embodiment of the present invention.

Next, as a fifth embodiment of the present invention, yet another structure of a reflection plate 14 is shown in FIG. 13, wherein a pair of reflection plate portions 14*c* are provided at the two respective sides of the base plate portion 14*a* of the reflection plate 14 by bending each side of the base plate portion 14*a* at nearly a right angle. Each reflection plate portion 14*c* has the same width as the base plate portion 14*a*, and, when attached to the socket, its upper end is nearly flush with the upper ends of the socket portions 22. Providing a pair of reflection plate portion 14*c* as above is not only effective in blocking the light radiated from the incandescent lamp 1 to both sides where the reflection plate portions 14*c* are located when the lamp is lit but also improves the efficiency of light reflection in the direction opposite the reflection plate portion 14, in other words the direction in which the pair of reflecting plate portions 14*c* extend.

Industrial Applicability

As described above, a socket and a socket device according to the present invention are suitable for connection of a straight tube-type incandescent lamp to be used for decorative illumination or general lighting, and can be used as a socket device by combining a socket with a variety of components, such as a flat cable or a base cover, or as a single, independent socket. Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A socket device to which a straight tube type incandescent lamp is connected, said incandescent lamp including a glass tube having a sealing portion at each end, a filament disposed in said glass tube, and a pair of lead wires connected to said filament, each lead wire having a generally U-shaped lead portion projecting from the sealing portion at a corresponding end of the glass tube to the outside of the glass tube, wherein said socket device comprises:

a socket body having a base portion and a pair of socket portions, said socket portions positioned opposite each other and respectively rising from two ends of said base portion as an integral body with said base portion, each socket portion having a sealing portion groove and a lead portion groove each adapted to permit said sealing portion and said lead portion respectively of said incandescent lamp to be respectively inserted therein and removed therefrom;

said sealing portion groove formed at an end of said socket portion facing toward the inner end of the other socket portion, said lead portion groove being narrower than said sealing portion groove and closer to the outer end of its socket portion than the sealing portion groove; and lamp contact terminals each of which having a pair of feeding terminal pieces, each lamp contact terminal so disposed in one of said pair of socket portions of the socket body as to face said lead portion groove and so that when said lead portion of said incandescent lamp is inserted into the lead portion groove, said lamp contact terminals secure the lead portion between said feeding terminal pieces, thereby connecting the lead portion to the lamp contact terminal.

2. A socket device as claimed in claim 1, wherein a protrusion is formed on one of each pair of said feeding terminal pieces protruding therefrom toward the other feeding terminal piece in the pair, said protrusion adapted to be removably engaged in said lead portion of said incandescent lamp when said lead portion is inserted between said pair of feeding terminal pieces.

3. A socket device as claimed in claim 1, wherein a stopper is formed on one of each pair of said feeding terminal pieces protruding therefrom toward the other feeding terminal piece in the pair, said stopper for limiting the insertion position of the lead portion of the incandescent lamp when said lead portion is inserted between said pair of feeding terminal pieces.

4. A socket device as claimed in claim 1, wherein a reflection plate is provided on the surface of the base portion of the socket body facing a space between the pair of socket portions.

5. A socket device as claimed in claim 4, wherein said reflection plate includes a base plate portion and protruding piece portions, said base plate portion is adapted to cover said base portion, and each one of said protruding piece portions protrudes from respective ends of said base plate portion and is adapted to be engaged in hemispherical protrusions disposed in the socket portion at corresponding ends of the socket body.

6. A socket device as claimed in claim 4, wherein each one of said socket portions is provided with a reflection plate support portion disposed on a base plate side of said socket portions for removably supporting a corresponding end of the reflection plate.

7. A socket device as claimed in claim 1, wherein each lamp contact terminal includes a receiving terminal portion that faces an underside of the base portion of the socket body.

8. A socket device as claimed in claim 7 further comprising:

a flat cable in the shape of a belt having belt-shaped flat electrical wires and a belt-shaped insulating cover that envelopes and insulates said flat wires, said flat cable adapted to permit the underside of the socket body to be joined and fixed thereto, and also to permit said receiving terminal portions of the respective lamp contact terminals to be connected to said flat wires.

9. A socket device as claimed in claim 8, wherein said socket device further includes an elongated rail having a generally U-shaped cross section, said cross section defining an interior having a bottom, said elongated rail adapted to house said flat cable along the bottom of the interior of the rail, and provided with catching portions that respectively extend along inner sides of the rail, said catching portions adapted to catch and support the socket body of said socket device.

10. A socket device as claimed in claim 7 further comprising:

a base cover joined to the underside of the socket body of said socket device having at least one pair of wire insertion holes; and a pair of line-connecting terminals disposed in said base cover, each line-connecting terminal having a connector portion and a lock terminal portion, said connector portion connected to the receiving terminal piece of each respective lamp contact terminal, each lock terminal portion facing a respective wire insertion hole and securing an electrical wire inserted into said wire insertion hole so that the electrical wire is connected without the danger of slipping.

11. A socket device as claimed in claim 10, wherein said wire insertion holes are formed at opposing ends of said base cover, said line-connecting terminals are disposed between the wire insertion holes within the base cover;

and wherein said lock terminal portion is provided at each end of each respective line-connecting terminal, at such a position as to face each respective insertion hole.

12. A socket device as claimed in claim 4 where said reflection plate further comprises:

a plurality of reflection plate portions each disposed perpendicularly to said base plate of said reflection plate, each reflection plate portion formed by bending a side of said reflection plate at nearly a right angle.

13. A socket device as claimed in 8 wherein said flat cable further comprises:

a plurality of window openings disposed in said belt shaped insulating cover for providing electrically conductive access of said electrical wires to said lamp contact terminals.

14. A socket device as claimed in claim 2 further comprising an indentation disposed on the other one of each pair of terminal pieces, said indentation formed to mate with said protrusion and for removably engaging said lead portion of said incandescent lamp when said lead portion is inserted between said pair of feeding terminal pieces.

15. A socket device as claim in claim 10 further comprising release buttons disposed at opposing ends of said base cover, said release buttons being effective when actuated for mechanically disengaging said lock terminal portions so that said electrical wires may be removed.

16. A socket device for a lamp having first and second lead portions extending from first and second opposed ends thereof comprising:

a socket having a base and a pair of socket portions;

said socket portions disposed on opposing ends of said base and each socket portion further having a groove portion for receiving one of said lead portions;

a lamp contact terminal disposed in each of said socket portions;

said lamp contact terminals each including first and second facing feeding terminal pieces resiliently biased toward each other;

said first and second feeding terminal pieces being effective to permit resilient spreading by insertion of one of said lead portions of a lamp into said groove portion; and a resilience of said first and second feeding terminal pieces being effective to mechanically retain said lead portion in said groove and to electrically connect said lead portion to a remainder of said socket.

17. A socket device as claimed in claim 16 further comprising:

a stopper disposed on each of said feeding terminal pieces extending toward the other feeding terminal piece.

18. A socket device as claimed in claim 16 further comprising:

a reflection plate disposed on the base portion of said socket; and means for supporting said reflection plate.

19. A socket device as claimed in claim 16 further comprising:

a cable having wires disposed within it;

said cable for mechanically connecting to said socket and for electrically coupling said wires within said cable to said lamp contact terminals.

20. A socket device as claimed in claim 19 further comprising an elongated rail for housing said cable.

21. A socket device as claimed in claim 16 further comprising:

a pair of line connecting terminals each having a connector portion and a lock terminal portion;

said connector portions each coupled to a respective lamp contact terminal; and said lock terminal portions each for electrically coupling and mechanically securing a wire to said lamp contact terminal.

22. A socket device as claimed in claim 21 further comprising a base cover for housing said line-connecting terminals.

23. An apparatus for electrically and mechanically connecting a power source to a lamp comprising:

a pair of electrical conductors disposed within an insulator;

said insulator having a plurality of openings providing electrical access to said wires;

a pair of lamp contact terminals each having a receiving terminal portion;

said receiving terminal portions each mechanically coupling and electrically connecting with said wires though said openings; and said receiving terminal portions further effective to mechanically couple and electrically connect to a lamp disposed in said socket device.

24. An apparatus as claimed in claim 23 further comprising an elongated rail for housing said insulator.

25. A lamp socket comprising:

first and second conductors;

a unitary insulation insulating said first and second conductors, and maintaining said first and second conductors in a fixed mutual relationship;

a first window through said insulation exposing said first conductor;

at least a second window through said insulation exposing said second conductor;

identical first and second contact terminals;

said first and second contact terminals each including first and second feeding terminals forming substantially planar first and second slots therebetween;

said first and second feeding terminals being resiliently biased toward each other thereby to receive and hold a lead portion of a lamp in their respective slots;

said first and second contact terminals including first and second receiving terminal portions, respectively, at bases thereof;

said first receiving terminal portion in a first rotational orientation fitting through said first window for connection to said first conductor;

said second receiving terminal portion in a second rotational orientation rotated 180 degrees from said first rotational orientation and fitting through said second window for connection to said second conductor; and said first and second receiving terminal portions being positioned on their respective first and second contact terminals, respectively, such that said first and second slots are substantially coplanar.

* * * * *